US010343047B2

(12) United States Patent
Lovat

(10) Patent No.: US 10,343,047 B2
(45) Date of Patent: Jul. 9, 2019

(54) MOUTHGUARD

(71) Applicant: OPRO International Limited, Hemel Hempstead Hertfordshire (GB)

(72) Inventor: Anthony Lovat, Shenley Hertfordshire (GB)

(73) Assignee: OPRO International Limited, Hemel Hempstead Hertfordshire (GB)

( * ) Notice: Subject to any disclaimer, the term of this patent is extended or adjusted under 35 U.S.C. 154(b) by 331 days.

(21) Appl. No.: 15/115,339

(22) PCT Filed: Jan. 22, 2015

(86) PCT No.: PCT/EP2015/051271
§ 371 (c)(1),
(2) Date: Jul. 29, 2016

(87) PCT Pub. No.: WO2015/113893
PCT Pub. Date: Aug. 6, 2015

(65) Prior Publication Data

US 2017/0001095 A1 Jan. 5, 2017

(30) Foreign Application Priority Data

Jan. 30, 2014 (GB) ..... 1401548.1

(51) Int. Cl.
*A63B 71/08* (2006.01)

(52) U.S. Cl.
CPC ..... *A63B 71/085* (2013.01)

(58) Field of Classification Search
CPC ... A61F 5/56; A61F 5/566; A61C 7/36; A61C 19/063; A61C 5/90; A63B 71/085; A63B 2071/086; A63B 2071/088
See application file for complete search history.

(56) References Cited

U.S. PATENT DOCUMENTS 3,624,909 A * 12/1971 Greenberg ..... A61C 19/063 433/217.1
5,746,221 A 5/1998 Jones et al.
7,125,251 B2 * 10/2006 Livolsi ..... A61C 9/0006 433/41

(Continued)

FOREIGN PATENT DOCUMENTS

DE 19705454 8/1998
DE 102004009883 5/2014

(Continued)

OTHER PUBLICATIONS

GB Search Report for corresponding GB Patent Application No. GB1401548.1 dated Jul. 29, 2014, 6 pages.

(Continued)

*Primary Examiner* — Kari K Rodriquez
(74) *Attorney, Agent, or Firm* — Lee & Hayes, P.C.

(57) ABSTRACT

A mouthguard (200) comprising: a base portion (210); an inner wall (212) extending from an inner edge (214) of the base portion; and an outer wall (216) extending from an outer edge (218) of the base portion, wherein an internal angle (234*a-e*) between the base portion and at least a portion of the outer wall is less than 90 degrees and an internal angle (232*a-e*) between the base portion and at least a portion of the inner wall is less than 90 degrees for gripping teeth of a wearer.

17 Claims, 6 Drawing Sheets

(56) References Cited

U.S. PATENT DOCUMENTS

| | | | | |
|---|---|---|---|---|
| 2008/0050693 | A1 | 2/2008 | Fischer et al. | |
| 2010/0129763 | A1 | 5/2010 | Kuo | |
| 2011/0185525 | A1* | 8/2011 | Stapelbroek ..... | A61C 7/08 15/167.1 |
| 2012/0285473 | A1 | 11/2012 | Wright | |
| 2013/0090627 | A1 | 4/2013 | Raghuprasad | |

FOREIGN PATENT DOCUMENTS

| | | |
|---|---|---|
| GB | 2437491 | 10/2007 |
| WO | WO2010/038171 | 4/2010 |

OTHER PUBLICATIONS

PCT Search Report for corresponding PCT Appication No. PCT/EP2015/051271 dated Mar. 16, 2015, 3 pages.

* cited by examiner

MOUTHGUARD

TECHNICAL FIELD

The invention relates to mouthguards. In particular, the invention relates to, but is not limited to, mouthguards for use by athletes participating in sport. Further, the invention may relate to stock mouthguards requiring no customisation, such as "boil and bite", to fit a user's mouth.

BACKGROUND

A mouthguard is a device worn in the mouth of a wearer and intended to protect the teeth and gums. Typically, mouthguards cover the top teeth and gums and are most often used to prevent injury to areas of the mouth during collisions between athletes in sports such as rugby and hockey. There are various names that may be given to a mouthguard, including gumshield, mouth protector, and mouth piece.

It is important that a mouthguard fits the wearer's mouth adequately such that when worn it is retained in a correct position in the mouth covering the teeth and gums of the wearer. This is especially important during a sporting event, where sudden motions of an athlete may cause a poorly fitting mouthguard to become dislodged from its fitted position. This can increase the risk of the athlete sustaining an injury to the mouth from a collision. Further, a mouthguard that is poorly fitting may have to be frequently put back into position in the wearer's mouth or retained in position by the user using their lower jaw or tongue, both of which could cause inconvenience or injury.

Broadly speaking, mouthguards may be split into three categories: custom mouthguards, self-fit (typically boil and bite) mouthguards and stock mouthguards. Self-fit mouthguards encompass mouthguards that may be fitted to a user's mouth after purchase and through some action by the wearer. Custom mouthguards may be fabricated using measurements or information obtained from the eventual intended wearer by a dental professional. Stock mouthguards encompass mouthguards that are purchased in a preformed shape. Stock mouthguards may be non-customised and/or non-customisable in respect of a wearer's mouth and should therefore fit a user straight "off the shelf".

Boil and bite mouthguards are typically manufactured from thermoplastic materials allowing a user to immerse the mouthguard in hot water until it becomes soft and pliable. Then the user places it into their mouth and uses their fingers, lips, tongue, cheeks and biting pressure shape the mouthguard to the contours of their mouth to achieve an improved fit.

However, although there can be an improved fit achieved from the boil and bite mouthguards, there are also disadvantages associated with them. The process of customising boil and bite mouthguards can be time consuming and require significant effort. Further, by customising the mouthguard using biting pressure, the walls of the mouthguard may become thin in places, and therefore not provide a suitable level of protection to parts of the teeth and gums.

Another type of customised mouthguard widely available is a custom mouthguard. Custom mouthguards can be produced using an impression of the prospective wearer's teeth and gums typically prepared by a dentist or other dental professional. The custom mouthguard is fabricated onto a plaster model made from the impression of the wearer's teeth and gums so that, when it is finished, it fits accurately into the wearer's mouth and is retained in the correct position.

Although custom mouthguards can provide an improved fit within the user's mouth, they require a wearer to obtain an impression of their teeth and then to pay a specialist to fabricate the mouthguard. This process can take up to several weeks. Obtaining a custom mouthguard can also be costly.

Stock mouthguards (also known as ready-made or non-customised mouthguards) are typically manufactured in a preformed shape and are often available to buy in different sizes directly "off the shelf". Stock mouthguards are typically cheaper than customisable mouthguards and are configured to be immediately usable upon purchase. Although stock mouthguards do not have the disadvantages associated with boil and bite and custom mouthguards outlined above, it is likely that they will not fit the wearer's mouth accurately and may not be retained in the correct position.

SUMMARY OF THE INVENTION

In light of the above, there is a need for a mouthguard that provides a better fit in the wearer's mouth when compared with mouthguards currently available. The mouthguard may be a stock mouthguard that is non-customisable. The mouthguard may be usable immediately upon purchase and can be retained in a correct position in a user's mouth when fitted without the need for adjustment.

According to the invention in a first aspect, there is provided a mouthguard comprising: a base portion; an inner wall extending from an inner edge of the base portion; and an outer wall extending from an outer edge of the base portion, wherein an internal angle between the base portion and at least a portion of the outer wall is less than 90 degrees and an internal angle between the base portion and at least a portion of the inner wall is less than 90 degrees for gripping teeth of a wearer.

According to the invention in another aspect, there is provided a mouthguard comprising: a front portion and first and second arms connected to the front portion, wherein at least one of the first and second arms comprises: an arm base portion; an arm inner wall extending from an inner edge of the base portion; and an arm outer wall extending from an outer edge of the base portion, and wherein the front portion comprises a front portion outer wall comprising a plurality of independently movable front portion outer wall sections rotatable relative to an adjacent front portion outer wall section to increase a separation between the first and second arms.

Optionally, at least a portion of the arm inner and/or arm outer walls is resiliently deformable for gripping the teeth of the wearer.

Optionally, the at least a portion of the arm inner and/or arm outer walls that is resiliently deformable is arranged to grip one or more of the molar and pre-molar teeth of the wearer.

Optionally, the mouthguard comprises first and second arms extending from a front portion to form a substantially u-shaped mouthguard.

Optionally, each of the first and second arms comprises a base portion, an arm inner wall and an arm outer wall.

Optionally, the inner wall comprises a first discrete section forming part of the first arm, and a second discrete section forming part of the second arm.

Optionally, the base comprises a first discrete base portion forming part of the first arm, and a second discrete base portion forming part of the second arm.

Optionally, at least a portion of an internal corner defined by the arm base portion and the arm inner wall and/or the arm outer wall is filleted.

Optionally, the outer arm wall comprises a plurality of independently movable arm outer wall portions. The plurality of independently movable arm outer wall portions may be defined by at least one notch extending from the top of the arm outer wall towards the arm base portion of the mouthguard.

Optionally, the independently movable front portion outer wall sections are defined by at least one notch in the front portion outer wall.

Optionally, the front portion outer wall forms a continuous outer wall with the arm outer wall of the first and second arms.

Optionally, the internal angle between the arm base portion and at least a portion of the outer wall is in the range from 75 to 85 degrees and the internal angle between the arm base portion and at least a part of the arm inner wall is in the range from 75 to 85 degrees.

Optionally, at least part of the arm outer wall and/or the at least part of the arm inner wall are configured to be in contact with an inclined surface of an undercut of a tooth of the wearer.

Optionally, the dimensions of the mouthguard are based on a model set of teeth, wherein the model set of teeth is determined based on data obtained from a plurality of sets of teeth.

Optionally, the model set of teeth comprises an average of the data obtained from a plurality of sets of teeth Optionally, the at least part of the arm inner wall and at least part of the arm outer wall are arranged to engage opposed sides of a model tooth of the model set of teeth.

Optionally, at least part of the arm inner wall and at least part of the arm outer wall comprise a plurality of independently movable arm outer wall portions, each arm outer wall portion being arranged to engage a tooth of the set of model teeth.

Optionally, the plurality of independently movable arm outer wall portions are each arranged so as to engage a tooth that is a molar or a premolar tooth within the set of model teeth.

Optionally, each of the first and second arms comprises an arm base portion, an arm inner wall and an arm outer wall.

Optionally, the mouthguard is a stock mouthguard.

According to the invention in another aspect, there is provided a mouthguard comprising: a base; an inner wall extending from an inner edge of the base; and an outer wall extending from an outer edge of the base, wherein at least a portion of the inner and outer walls is configured to grip a model tooth of a model set of teeth determined based on data obtained from a plurality of sets of teeth.

According to the invention in another aspect, there is provided a method of manufacturing a mouthguard, the method comprising: determining a model set of teeth based on data obtained from a plurality of sets of teeth; forming a mouthguard comprising a base, an inner wall extending from an inner edge of the base and an outer wall extending from an outer edge of the base, wherein at least a portion of the inner and outer walls is configured to grip a model tooth of the model set of teeth.

BRIEF DESCRIPTION OF THE DRAWINGS

Exemplary embodiments of the invention will now be described with reference to the accompanying drawings, in which.

DETAILED DESCRIPTION

As has been outlined above, there is a need for a mouthguard that is non-customisable and that provides a better fit in a wearer's mouth such that it will be retained in the correct position when worn by a wearer.

It has been identified by the inventors that the natural undercut of molar and pre-molar teeth can be utilized to manufacture a mouthguard with an improved fit and improved retention properties. In addition, the inventors have appreciated that major differences between the teeth of users lie in the width of the arch of the teeth and that a mouthguard capable of adjustment in width would provide a better fit to a greater number of users.

Figure 1:
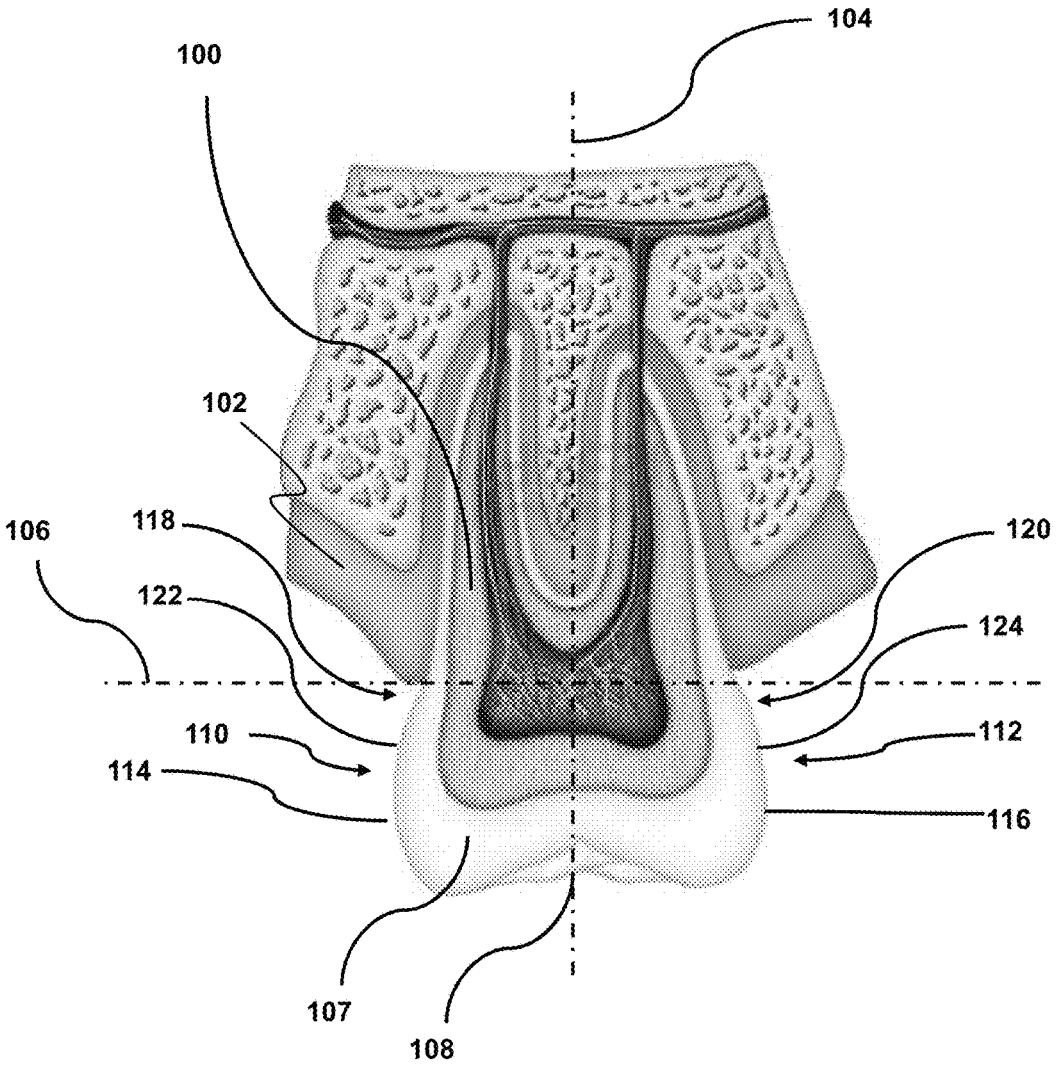
FIG. 1 is a section through an exemplary molar tooth.

FIG. 1 shows a cross section through an exemplary upper molar tooth and gums. A molar tooth is shown in FIG. 1 although similar features may also be seen in premolar teeth.

FIG. 1 shows a tooth 100 and a gum 102. A vertical axis 104 and a horizontal axis 106 are shown associated with the tooth 100. The horizontal axis 106 intercepts the tooth 100 at the gum-line. The portion 107 of the tooth below the gum-line in FIG. 1 is the portion of the tooth that is visible.

It is noted that relative terms such as vertical, horizontal, side, top, bottom, inner, outer, above, below etc. are used herein for descriptive purposes and need not limit the scope of the methods and apparatus disclosed.

The tooth 100 comprises an axial surface 108, an outer side surface 110 and an inner side surface 112. The horizontal width across the molar tooth 100 (i.e., the distance between the side surfaces 110, 112) is less at the gum-line than at other vertical positions on the visible tooth. More specifically, the side surfaces 110, 112 comprise lateral maxima 114, 116 at which the horizontal width of the tooth 100 is at a maximum. These maxima 114, 116 are located some distance below the gum-line, such that the width of the tooth 100 decreases with vertical position towards the gum-line. This decrease in width of the tooth 100 results in undercuts 118, 120 at the base of the tooth 100 on the inner and outer sides 110, 112. Methods and apparatus disclosed herein exploit the undercuts 118, 120 on the inner and outer sides 110, 112 of the tooth 100. However, it will be appreciated that the undercut exists on all sides of the tooth 100. The undercuts 118, 120 produce inclined surfaces 122, 124 running from the lateral maxima towards the gum-line.

The representation of FIG. 1 is typical for molar and premolar teeth. Teeth at the front of the mouth (i.e. incisors and canines) typically do not have any significant natural undercut as described above although there may be a reduced undercut on those teeth that may be exploited by the methods and apparatus disclosed herein.

The inventors have appreciated that it is possible to produce a stock mouthguard with an improved fit and that can be more effectively retained in the correct position in the wearer's mouth. This can be achieved by configuring the stock mouthguard to grip the inclined surfaces 122, 124 defined by the natural undercuts 118, 120 of a tooth 100.

Figure 2:
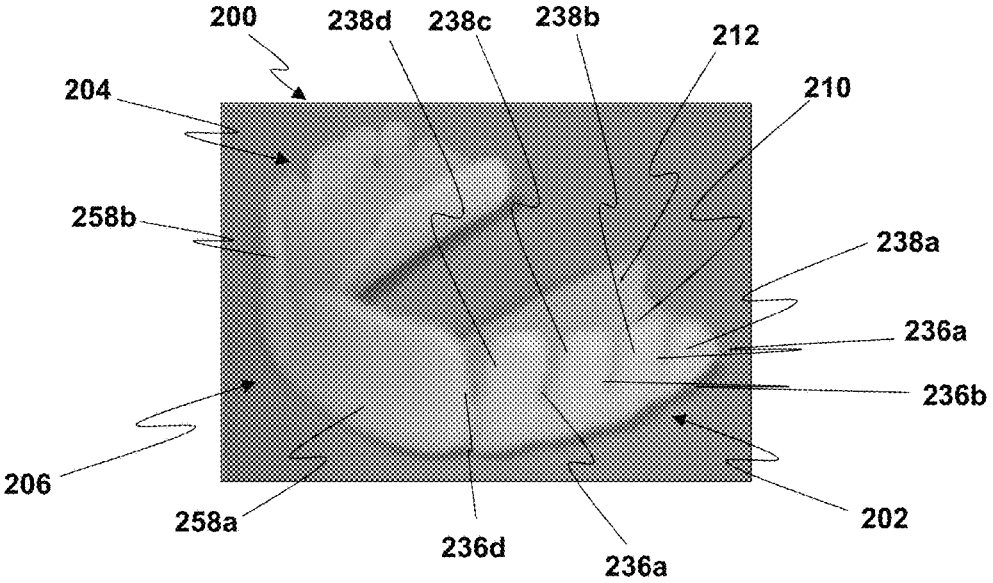
FIG. 2 is a schematic perspective view of a mouthguard.
Figure 3:
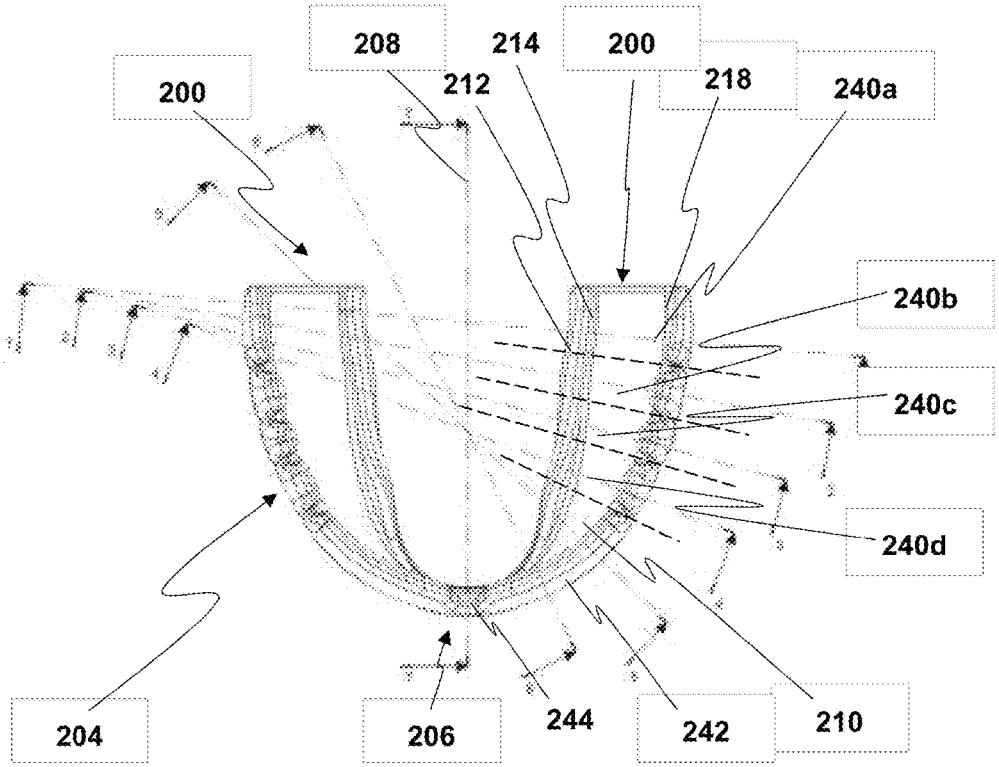
FIG. 3 is a schematic plan view of a mouthguard.
Figure 4:
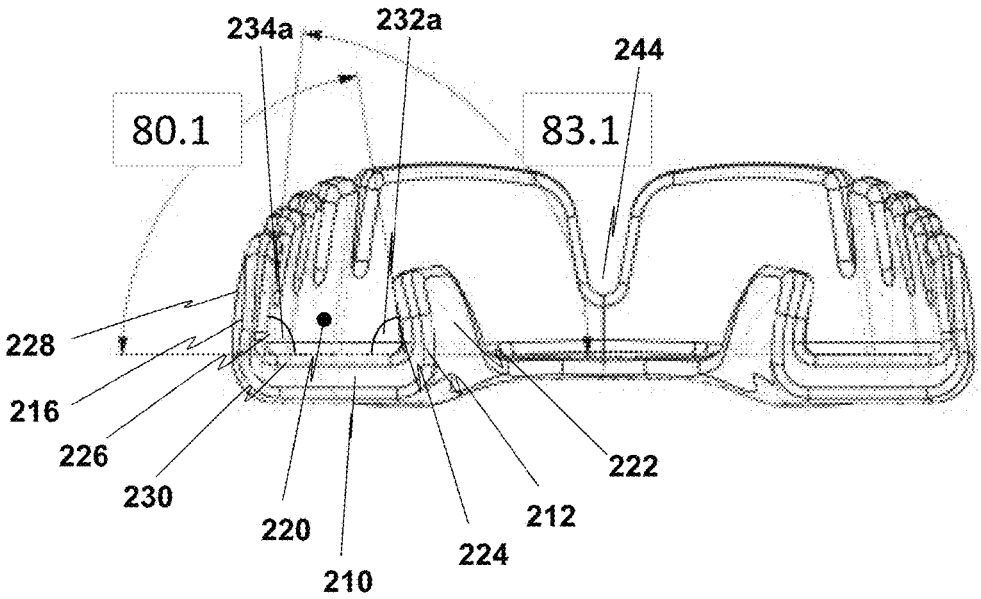
FIG. 4 is a schematic rear view of a mouthguard.

FIG. 2 shows a perspective view of an exemplary mouthguard 200, FIG. 3 shows a plan view of an exemplary mouthguard 200 and FIG. 4 shows a rear elevation of an exemplary mouthguard 200.

Referring to FIGS. 2 to 4, the mouthguard 200 comprises a first arm 202 and a second arm 204 extending from a front portion 206. The front portion 206 makes a connection between the first and second arms 202, 204. In use, the front portion 206 corresponds to the position of the front teeth of the wearer and the first and second arms 202, 204 correspond to the position of the left and right premolar and molar teeth. The mouthguard 200 may be substantially U-shaped with the first and second arms 202, 204 forming first and second substantially straight sections of the U-shape and the front portion 206 forming the curved section of the U-shape that connects to the first and second substantially straight sections. The mouthguard 200 has reflective symmetry about a central axis 208. That is, the first and second arms 202, 204 are substantially mirror images of each other.

The first arm 202 comprises a discrete arm base portion 210. The arm base portion 210 corresponds to the axial surface 108 of a tooth 100 and presents a flat inner surface that sits against the axial surfaces 108 of the premolar and molar teeth when the mouthguard 200 is in use. The arm base portion 210 extends along at least part of the length of the first arm 202. The arm base portion 210 terminates before the front portion 206 of the mouthguard 200, although in certain exemplary mouthguards, the arm base portion may continue at the front portion 206 to form a front portion base and connect with a corresponding arm base portion of the second arm 204.

The first arm 202 comprises a discrete arm inner wall 212 extending from an inner edge 214 of the arm base portion 210. The inner edge 214 of the arm base portion 210 extends along the length of the first arm 202. The arm inner wall 212 extends upwards from the base portion 210 and extends along the inner edge 214 of the arm base portion 210.

The first arm 202 further comprises an arm outer wall 216 extending from an outer edge 218 of the arm base portion 210. The outer edge 218 of the arm base portion 210 runs along at least part of the length of the first arm 202. The arm outer wall 216 extends upwards from the arm base portion 210 and along the outer edge 218 of the arm base portion 210.

A channel 220 is formed in the first arm 202 from the arm base portion 210, the arm inner wall 212, and the arm outer wall 216.

The arm inner wall 212 comprises an outer surface 222 and an inner surface 224. The inner surface 224 faces in towards the channel 220 and is opposed to the outer surface 222. Similarly, the arm outer wall 216 comprises an inner surface 226 and an outer surface 228. The inner surface 226 faces in towards the channel 220 and is opposed to the outer surface 228. Therefore, the channel 220 is formed from an upper surface 230 of the arm base portion 210, the inner surface 224 of the arm inner wall 212 and the inner surface 226 of the arm outer wall 216.

An internal corner 232*a* is formed between the upper surface 230 of the arm base portion 210 and the inner surface 224 of the arm inner wall 212, where the two surfaces meet. An angle of the internal corner 232*a* is less than 90 degrees. In exemplary mouthguards 200, the angle of the internal corner 232*a* may be in a range from 80 to 85 degrees or a range from 82 to 84 degrees. In the specific exemplary mouthguard of FIG. 3, the angle of the internal corner 232*a* is 83.1 degrees.

Another internal corner 234*a* is formed between the upper surface 230 of the base portion 210 and the inner surface 226 of the arm outer wall 216. An angle of the internal corner 234*a* is less than 90 degrees. In exemplary mouthguards 200, the angle of the internal corner 234*a* may be in a range from 77 to 83 degrees or a range from 79 to 81 degrees. In the specific exemplary mouthguard of FIG. 3, the angle of the internal corner 234*a* is 80.1 degrees.

Therefore, the inner surfaces 224, 226 of the arm inner and arm outer walls 212, 216 are inclined inwardly towards the channel 220 with respect to the base portion 210.

In FIG. 4, the internal corners 232*a*, 234*a* have been clarified by the addition of lines broadly following the directions of the inner surfaces 224, 226 and the upper surface 230 of the arm base portion 210. However, it is noted that the inner surfaces 224, 226 of the inner and outer walls 212, 216 may not be completely straight. The inner surfaces 224, 226 may be contoured and may, for example arc inwardly towards the channel 220. The angles specified for the internal corners 232*a*, 234*a* may therefore be generalised with respect to the actual internal surfaces 224, 226. The specified angles may, for example, correspond to an average angle, a best fit angle or an angle at the base of the arm inner and arm outer walls 212, 216.

The internal angles 232*a*, 234*a* may be formed to correspond to the shape of a tooth 100. That is, the internal angles 232*a*, 234*a* and the contours of the inner surfaces 222, 226 may be shaped to correspond to the side surfaces 110, 112 of a tooth 100. In particular exemplary mouthguards, the internal angles 232*a*, 234*a* and the contours of the inner surfaces 222, 226 may be shaped to correspond to the side surfaces 110, 112 of a model tooth determined based on data from a plurality of teeth.

The internal angles 232*a*, 234*a* and/or the contours of the inner surfaces 222, 226 allow the inner surfaces 222, 226 to engage with the inclined surfaces 122, 124 of a tooth that form the undercuts, thereby gripping the tooth and holding the mouthguard 200 in position.

The width of the arm base portion 210 is defined as the lateral distance between the inner edge 214 and the outer edge 218 of the arm base portion 210. The width of the arm base portion 210 varies along the length of the first arm 202. In particular, the width of the arm base portion 210 narrows towards the front portion 206 and is configured to accommodate the premolars and molars of a wearer of the mouthguard 200.

The inner edge 214 of the arm base portion 210 is configured broadly to match an inner edge of premolar and molar teeth of the wearer. Similarly, the outer edge 218 of the arm base portion 210 is configured broadly to match an outer edge of premolar and molar teeth of the wearer and is curved inwardly into the channel 220. Therefore, the channel 220 narrows towards the front portion 206, as the teeth of the wearer narrow towards the front teeth.

The arm inner wall 212 and arm outer wall 216 of the first arm 202 are resiliently deformable. Further, the height of the arm inner wall 212 varies along the length of the first arm 202 and is configured to match the height of each visible tooth 107 at a corresponding position along the length of the first arm 202 when worn.

The height of the arm outer wall 218 extending from the base portion 210 varies along the length of the first arm 202. Broadly, the general height of the arm outer wall increases along the length of the first arm 202 towards the front portion 206. The height of the arm outer wall 216 extending from the arm base portion 210 is configured to cover substantially the visible tooth 107 at a corresponding location along the length of the first arm 202.

The arm outer wall 216 curves inwardly to the channel of the first arm 202 as it extends vertically from the arm base portion 210. This curvature facilitates gripping of the teeth and the natural undercuts 118, 120 of the teeth of the wearer. The arm outer wall 216 is resiliently deformable.

The arm outer wall 216 of the first arm 202 comprises a plurality of independently movable arm outer wall portions 238*a-d*. The independently movable arm outer wall portions 238*a-d* may correspond positionally to one or more teeth of a wearer of the mouthguard. That is, the independently movable arm outer wall portions 238*a-d* may be positioned such that they each cover one or more teeth of the wearer. Each of the independently movable arm outer wall portions 238*a-d* of the arm outer wall 216 is independently laterally deformable. This allows each of the portions to accommodate and grip differently sized teeth of the wearer more effectively.

In the exemplary mouthguard 200, the independently movable arm outer wall portions 238*a-d* are formed by a plurality of notches 236*a-d* that are spaced along the arm outer wall 216. The notches 236*a-d* extend from the top of the arm outer wall 216 towards a base of the arm outer wall 216 at the outer edge 218 of the arm base portion 210. The notches 236*a-d* may extend approximately half way down the arm outer wall 216. The notches 236*a-d* become increasingly thin as they extend downwards from the top of the arm outer wall 116 towards the outer edge 218 of the arm base portion 210. In other exemplary mouthguards, the independently movable arm outer wall portions 238*a-d* may comprise another means for allowing independent movement. For example, the independently movable arm outer wall portions 238*a-d* may be at least partially connected by a section of different material that may have greater flexibility than the independently movable arm outer wall portions 238*a-d*. Other means for allowing independent movement of the independently movable arm outer wall portions 238*a-d* are possible.

The notches 236*a-d* define the plurality of discrete arm outer wall portions 238*a-d* of the arm outer wall 216 of the first arm 202. Each discrete arm outer wall portion 238*a-d* in isolation is resiliently deformable. Further, each discrete arm outer wall portion 238*a-d* may correspond to a particular tooth of the wearer of the mouthguard 200. That is, each discrete arm outer wall portion 238*a-d* may be configured to engage with an outer inclined surface 122 of one of the wearer's teeth. The discrete arm outer wall portions 238*a-d* therefore provide a mouthguard that has greater flexibility of fit with a wearer's teeth and is therefore able to fit a greater number of wearer's "off the shelf".

The exemplary mouthguard disclosed herein provides the independently movable arm outer wall portions 238*a-d* by way of notches 236*a-d* that are formed by removal of material from the arm outer wall 216 of the first arm 202 such that independent movement is possible. It is noted that the independent movement may be provided in other ways, such as by the provision of a less stiff and/or more elastic material between the independently movable arm outer wall portions 238*a-d*. In addition, although it is not shown in the accompanying drawings, the arm inner wall 212 may comprise corresponding independently movable arm inner wall portions in opposed locations to the independently movable arm outer wall portions 238*a-d* of the arm outer wall 216.

As shown in FIG. 3, the first arm 202 may comprise a plurality of sections 240*a-d* that correspond to the arm outer wall portions 238*a-d*. Each of the sections 240*a-d* may be configured to grip a particular tooth of the wearer of the mouthguard 200. That is, the internal angles 232*a-e*, 234*a-e* and/or the contours of the inner surfaces 222, 226 of each section 240*a-d* may be configured to grip the inclined surfaces 122, 124 of a tooth of the wearer. As such, the internal angles 232*a-e*, 234*a-e* and/or the contours of the inner surfaces 222, 226 of each section 240*a-d* may differ from those of other sections 240*a-d*.

The internal corners 232*a-e*, 234*a-e* formed from where the upper surface 230 of the arm base portion 210 and inner surfaces 222, 226 of the arm inner and arm outer walls 212, 216 meet may be filleted. That is, the internal corners 232*a-e*, 234*a-e* may be rounded. The filleted corners may be configured to correspond to the shape of one or more of the wearer's teeth. This may prevent or reduce an air gap existing between the inner surfaces 222, 226 and the upper surface 230 and the wearer's teeth.

FIGS. 5 to 8 show cross sections through the mouthguard 200 corresponding to cross sections 1-1, 2-2, 3-3 and 4-4 respectively, as shown in FIG. 3. Each cross section shows exemplary angles of the internal corners 232*b-e*. The angles of the internal corners 232*a-e*, 234*a-e* are shown to vary at different sections along the length of the first arm 202. The sections of FIGS. 5 to 8 show the angles at specific points along the first arm 202. However, it is noted that the angles may vary gradually along the length of the first arm to fit the model set of teeth.

Figure 5:
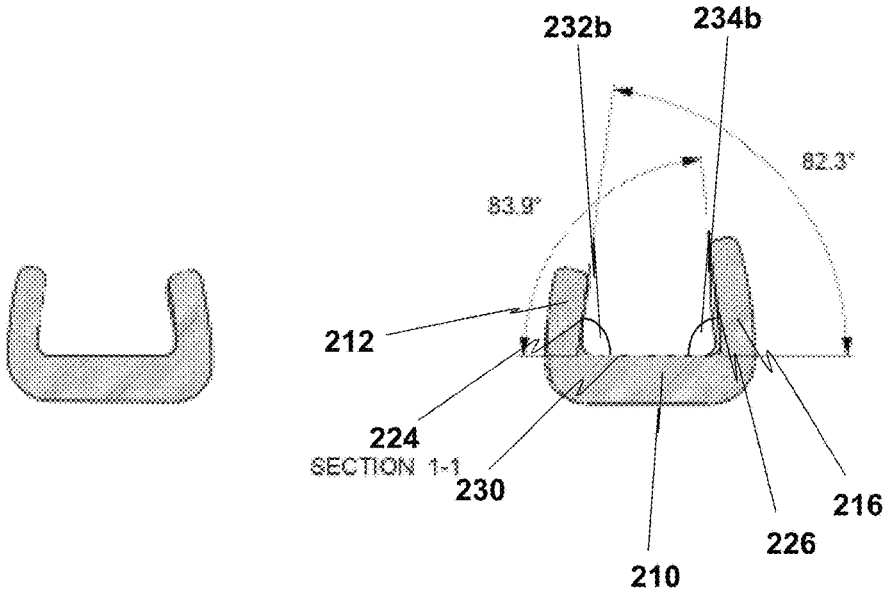
FIGS. 5 to 11 are schematic cross sections through a mouthguard.

Referring to FIG. 5, the internal angle 234*b* in section 240*a* may be in a range from 80 to 85 degrees or a range from 81 to 83 degrees. In the specific exemplary mouthguard 200, the angle of the internal corner 234*b* is 82.3 degrees. The internal angle 232*b* in section 240*a* may be in a range from 81 to 86 degrees or a range from 83 to 85 degrees. In the specific exemplary mouthguard 200, the angle of the internal corner 232*b* is 83.9 degrees.

Figure 6:
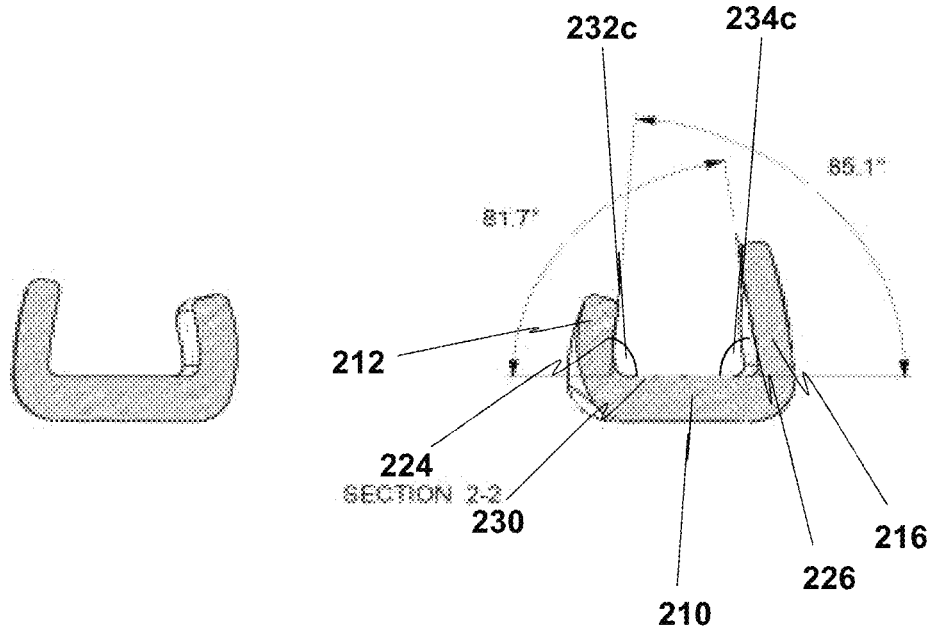

Referring to FIG. 6, the internal angle 232*c* in section 240*b* may be in a range from 79 to 84 degrees or a range from 80 to 83 degrees. In the specific exemplary mouthguard 200, the angle of the internal corner 232*c* is 81.7 degrees. The internal angle 234*c* in section 240*b* may be in a range from 82 to 87 degrees or a range from 83 to 86 degrees. In the specific exemplary mouthguard 200, the angle of the internal corner 234*c* is 83.9 degrees.

Figure 7:
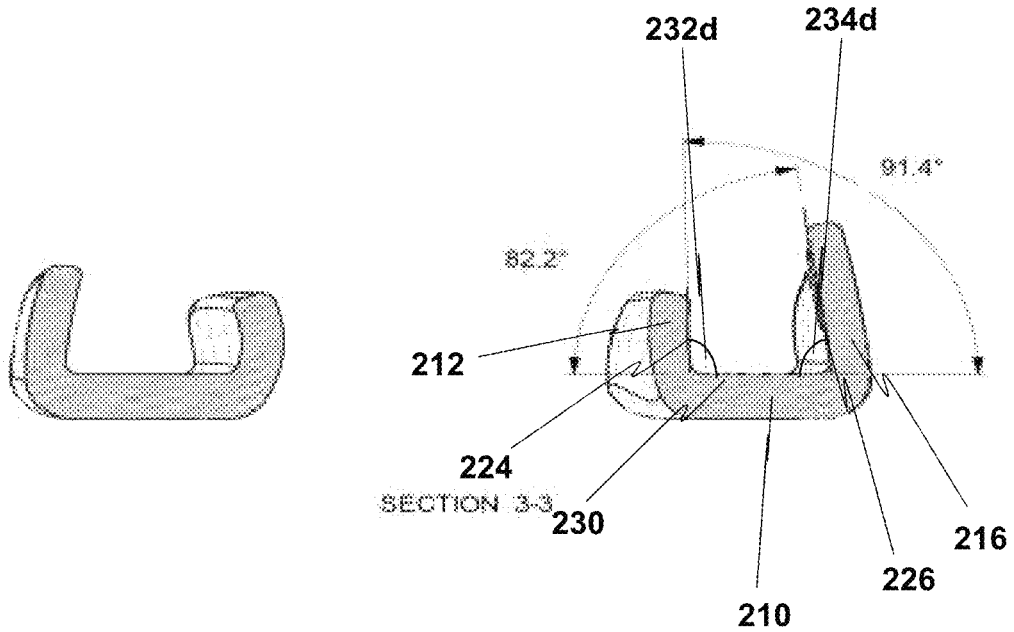

Referring to FIG. 7, the internal angle 232*d* in section 240*c* may be in a range from 89 to 94 degrees or a range from 90 to 92 degrees. In the specific exemplary mouthguard 200, the angle of the internal corner 232*d* is 91.4 degrees. The internal angle 234*d* in section 240*c* may be in a range from 79 to 85 degrees or a range from 81 to 93 degrees. In the specific exemplary mouthguard 200, the angle of the internal corner 234*d* is 82.2 degrees.

Figure 8:
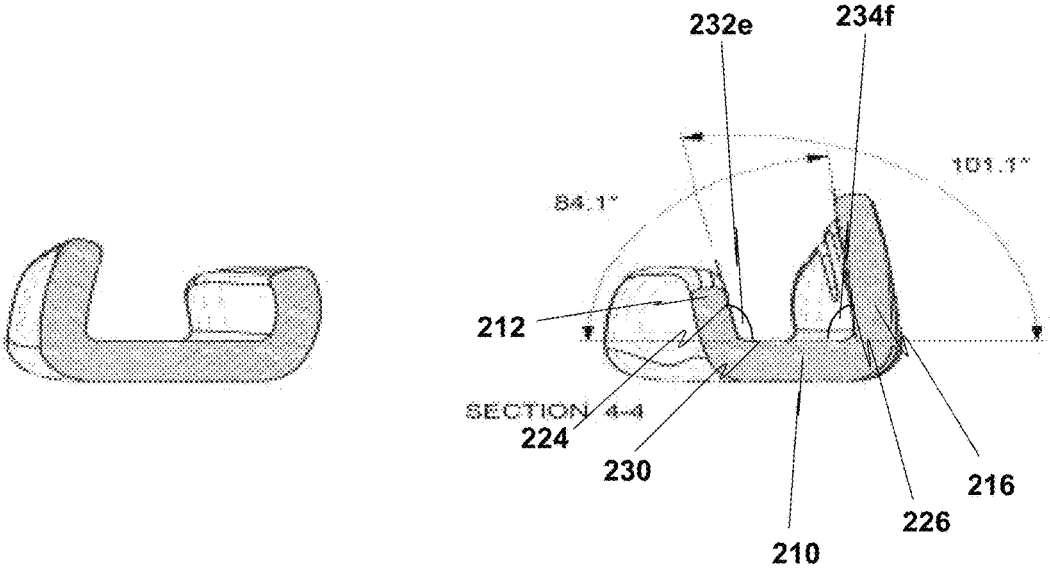

Referring to FIG. 8, the internal angle 232*e* in section 240*d* may be in a range from 98 to 104 degrees or a range from 100 to 102 degrees. In the specific exemplary mouthguard 200, the angle of the internal corner 232*e* is 101.1 degrees. The internal angle 234*e* in section 240*d* may be in a range from 82 to 87 degrees or a range from 83 to 85 degrees. In the specific exemplary mouthguard 200, the angle of the internal corner 234*e* is 84.1 degrees.

In view of FIGS. 7 and 8, it is noted that an internal angle defined by at least a portion of the arm inner wall 212 and the arm base 210 may be 90 degrees or greater.

Figure 9:
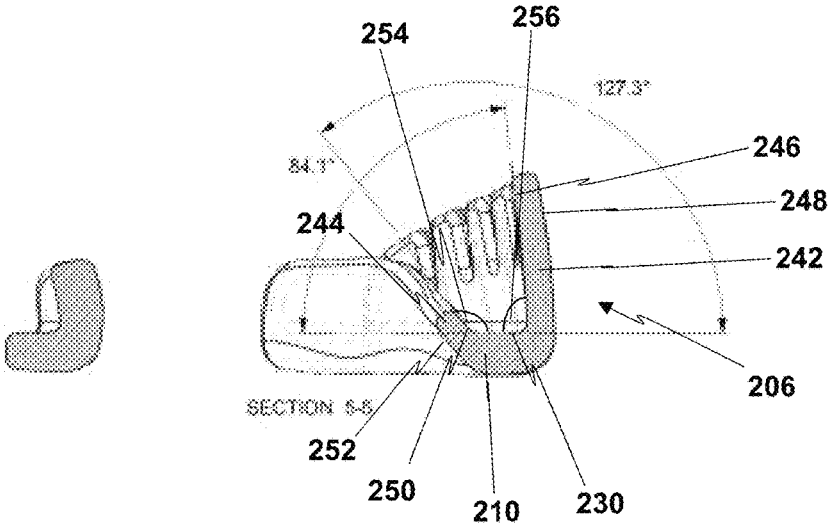
Figure 10:
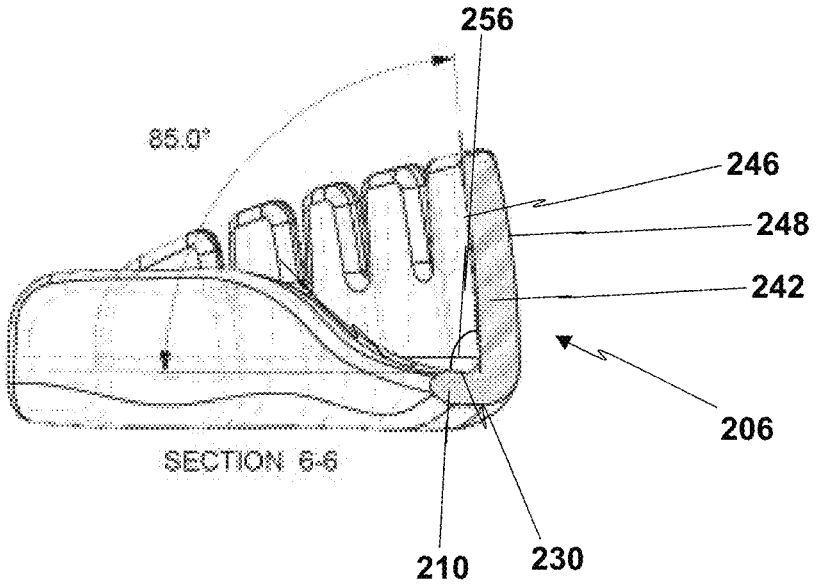
Figure 11:
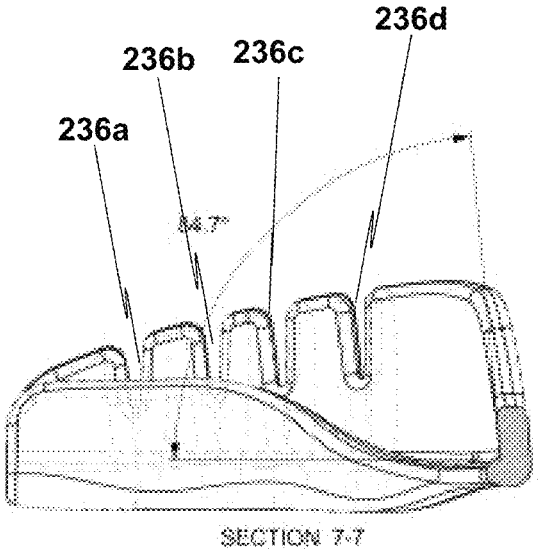

FIGS. 9 to 11 show further cross sections through the mouthguard 200 corresponding to cross sections 5-5, 6-6 and 7-7 respectively, as shown in FIG. 3. FIGS. 9 to 11 show the internal angles of the front portion 206 and the final stages of the internal wall 212.

The front portion 206 comprises a front portion outer wall 242 which extends along at least part of the length of the front portion 206. The front portion outer wall 242 connects to the arm outer wall 216 of the first arm 202 and to the corresponding arm outer wall of the second arm 204. As such, the arm outer wall 216 of the first arm 202, the front portion outer wall 242 and the arm outer wall of the second arm 204 may form a continuous outer wall of the mouthguard 200. The front portion 206 comprises a front portion internal wall 244. The front portion internal wall extends at least partially from the arm internal wall 212 of the first arm 202 along the length of the front portion 206.

In exemplary mouthguards, the arm base portions 210 of the first and second arms 202, 204 may not extend entirely across the front portion 206. Therefore, the front portion 206 may not comprise a front portion base along its entire length. However, in the exemplary mouthguard 200, the arm base portions 210 do extend at least partially into the front portion 206 and in some exemplary mouthguards, the front portion 206 may include a front portion base along its entire length. This front portion base covers the bottom of the upper front teeth of a wearer to protect them from impact from the lower front teeth.

The front portion external wall 242 comprises an inner surface 246 and an outer surface 248. The front portion internal wall 244 comprises an inner surface 250 and an outer surface 252. In FIG. 9, the arm base 210 can be seen to extend into the front portion 206. Therefore, an internal corner 254 is defined between the inner surface 250 of the arm internal wall 244 and an upper surface 230 of the arm base 210. Another internal corner 256 is defined between the inner surface 246 of the front portion outer wall 242 and the upper surface 230 of the arm/front portion base 210.

In FIG. 9, the internal angle 254 may be in a range from 125 to 130 degrees or a range from 127 to 128 degrees. In the specific exemplary mouthguard 200, the angle of the internal corner 254 is 127.3 degrees. The internal angle 256 may be in a range from 82 to 87 degrees or a range from 83 to 85 degrees. In the specific exemplary mouthguard 200, the angle of the internal corner 256 is 84.1 degrees.

Referring to FIG. 10, the internal wall 244 has been tapered into the arm base 210 and no longer extends vertically from the arm base 210. The internal angle 256 may be in a range from 82 to 87 degrees or a range from 84 to 86 degrees. In the specific exemplary mouthguard 200, the angle of the internal corner 256 is 85 degrees.

Referring to FIG. 11, which is a cross section along the centre line of the mouthguard 200 along the central axis 208, the internal angle 256 may be in a range from 82 to 87 degrees or a range from 84 to 86 degrees. In the specific exemplary mouthguard 200, the angle of the internal corner 256 is 84.7 degrees.

It is noted that the internal angles 254, 256 may vary gradually along the length of the front portion 206. The internal angles 254, 256 and the contours of the inner surfaces 246, 250 may be configured to correspond to the contours of teeth from the model set of teeth.

The second arm 204 is a mirror version of the first arm 202 across the central axis 208 of the mouthguard 200. The second arm 204 comprises the same or similar features as those described above for the first arm 202, although each feature is a mirror version of the corresponding feature of the first arm 202. As such, the second arm 204 is not discussed in detail.

The front portion outer wall 242 of the front portion 206 comprises a plurality of independently movable front portion outer wall sections 258*a-b*. The independently movable front portion outer wall sections 258*a-b* may be provided with independent movement by any suitable means, an example of which is shown in the accompanying figures. The movable front portion outer wall sections 258*a-b* may be independently deformable laterally outwardly and laterally inwardly in a similar way to the independently movable arm outer wall portions 238*a-d* of the outer wall 216 of the first arm 202. The independently movable front portion outer wall sections 258*a-b* may be rotationally movable with respect to each other to allow movement of the first and second arms 202, 204 away from the central axis 208. In particular, the independent rotation may be in a plane of the mouthguard. This allows easy and effective adjustment to the width of the arch of the mouthguard to fit the arch of a greater number of potential wearers.

In the exemplary mouthguard 200, there are two independently movable front portion outer wall sections 258*a-b* formed by a notch 244. The means for providing independent movement comprises the notch 244. The notch 244 is located halfway along the outer wall portion 242 on the central axis 208. The notch 244 extends downwards from the top of the outer wall 242 towards the bottom of the outer wall 242. The notch 244 becomes increasingly thinner as it approaches the bottom of the outer wall 242 and terminates approximately halfway down the outer wall 242.

In addition, the means for providing independent movement may comprise a front portion base with a reduced width compared with the arm base 210 and/or there may be no front portion inner wall at the point between the front portion outer wall sections 258*a-b*. This makes the relative rotation of the front portion outer wall sections 258*a-b* and the corresponding movement of the first and second arms easier.

In use, the wearer pushes the mouthguard 200 over the top set of teeth adjusting the position of the first and second arms 202, 204 as they do so to fit the width of the arch of their teeth, by virtue of the front portion outer wall sections 258*a-b*. Each of the discrete arm outer wall portions 238*a-d* of the arm outer walls 216 of the first and second arms 202, 204 is prised apart to pass over the outer lateral maximum 114 of a tooth of the wearer. Similarly, each of the sections 240*a-d* of the arm inner walls 212 of the first and second arms 202, 204 is prised apart to pass over the inner lateral maximum 116 of a tooth of the wearer. Therefore, when the wearer fits the mouthguard 200 to their teeth, the arm inner and arm outer walls, 212, 216 are prised further apart to fit over the maxima 114, 116 of each tooth and then return toward the resting position (shown in the figures). The independent deformation of the discrete arm outer wall portions 238*a-d* of the first and second arms 202, 204 allows individual teeth or groups of teeth to be gripped firmly irrespective of the dimensions of those teeth relative to the size and shape of the mouthguard. As the walls 212, 216 return to the resting position, the inner surfaces 222, 226 engage with the inclined surfaces 122, 124 of at least one tooth of the wearer. The mouthguard 200 is thereby able to grip the teeth of the wearer.

The front portion 206 is adjacent to an outer surface of the front teeth of the wearer.

As mentioned above, the internal angles the internal angles 232*a-e*, 234*a-e* and/or the contours of the inner surfaces 224, 226 of each section 240*a-d* may be configured to grip one or more teeth of a model set of teeth. The model set of teeth may be determined based on data from a plurality of sets of teeth. The dimensions and relative tooth positions from a plurality of sets of teeth may be measured and recorded. This data may then be used to determine typical dimensions and relative tooth positions for a typical set of teeth. The data may, for example, be used to determine average dimensions, average relative tooth positions and an average width of the arch of the teeth. When determining the average dimensions, positions and width outliers representing extreme sets of teeth may be removed. Use of this data allows the manufacture of a mouthguard 200 that will fit the model set of teeth being an average of the data from the plurality of sets of teeth. When such a mouthguard is accompanied by one or more of the features described above, the mouthguard may be fitted to a majority of wearers.

The mouthguards disclosed herein may be stock mouthguards that are able to be fitted to a wearer's teeth without the need for any customisation, such as boil and bite. The mouthguards disclosed herein may be manufactured from a material that does not have the thermo-plastic qualities required for a boil and bite mouthguard, that is, the ability to become plastic above a certain temperature and set in a new position after cooling. However, other exemplary mouthguards may be manufactured from a thermo-plastic material such that, in addition to the adjustment features disclosed herein, further adjustment may be provided by boil and bite methods.

The skilled person will be able to envisage further exemplary methods and apparatus, as set out in the accompanying drawings.

The invention claimed is:

1. A mouthguard to protect teeth against impact, the mouthguard comprising:

a front portion and first and second arms connected to the front portion, wherein at least the first arm comprises:

a first arm base portion;

a first arm inner wall extending from an inner edge of the first arm base portion; and a first arm outer wall extending from an outer edge of the first arm base portion, and wherein the front portion comprises a front portion outer wall comprising a plurality of independently movable front portion outer wall sections rotatable relative to an adjacent front portion outer wall section to increase a separation between the first and second arms and wherein at least a portion of the first arm inner wall and first arm outer wall is resiliently deformable, for gripping the teeth of the wearer.

2. The mouthguard of claim 1, wherein an internal angle between the first arm base portion and at least a portion of the first arm outer wall is less than 90 degrees and an internal angle between the first arm base portion and at least a portion of the first arm inner wall is less than 90 degrees, for gripping teeth of a wearer.

3. The mouthguard of claim 1, wherein the at least a portion of the first arm inner wall and first arm outer wall that is resiliently deformable is arranged to grip one or more of the molar and pre-molar teeth of the wearer.

4. The mouthguard of claim 1, wherein at least a portion of an internal corner defined by the first arm base portion and the first arm inner wall and/or the first arm outer wall is filleted.

5. The mouthguard of claim 1, wherein the first arm outer wall comprises a plurality of independently movable first arm outer wall portions.

6. The mouthguard of claim 5, wherein the plurality of independently movable first arm outer wall portions are defined by at least one notch extending from the top of the first arm outer wall towards the first arm base portion of the mouthguard.

7. The mouthguard of claim 1, wherein the independently movable front portion outer wall sections are defined by at least one notch in the front portion outer wall.

8. The mouthguard of claim 1, wherein the front portion outer wall forms a continuous outer wall with the first arm outer wall of the first arm and a second arm outer wall of the second arm.

9. The mouthguard of claim 1, wherein the internal angle between the first arm base portion and at least a portion of the first arm outer wall is in the range from 75 to 85 degrees and the internal angle between the first arm base portion and at least part of the first arm inner wall is in the range from 75 to 85 degrees.

10. The mouthguard of claim 1, wherein at least part of the first arm outer wall and/or at least part of the first arm inner wall are configured to be in contact with an inclined surface of an undercut of a tooth of the wearer.

11. The mouthguard of claim 1, wherein the dimensions of the mouthguard are based on a model set of teeth, wherein the model set of teeth is determined based on data obtained from a plurality of sets of teeth.

12. The mouthguard of claim 11 wherein the model set of teeth comprises an average of the data obtained from a plurality of sets of teeth.

13. The mouthguard of claim 11, wherein the at least part of the first arm inner wall and at least part of the first arm outer wall are arranged to engage opposed sides of a model tooth of the model set of teeth.

14. The mouthguard of claim 11, wherein at least part of the first arm outer wall comprises a plurality of independently movable first arm outer wall portions, individual of the independently movable first arm outer wall portion being arranged to engage a tooth of the set of model teeth.

15. The mouthguard of claim 14 wherein the plurality of independently movable first arm outer wall portions are each arranged so as to engage a tooth that is a molar or a premolar tooth within the set of model teeth.

16. The mouthguard according to claim 1, wherein the second arm comprises a second arm base portion, a second arm inner wall, and a second arm outer wall.

17. The mouthguard of claim 1, wherein the mouthguard is a stock mouthguard.

* * * * *